US007892103B2

(12) United States Patent
Vahary

(10) Patent No.: US 7,892,103 B2
(45) Date of Patent: Feb. 22, 2011

(54) MOVE POWER SYSTEM FOR GOLF

(75) Inventor: Jerome A Vahary, Naperville, IL (US)

(73) Assignee: Jerome Vahary, Naperville, IL (US)

( * ) Notice: Subject to any disclaimer, the term of this patent is extended or adjusted under 35 U.S.C. 154(b) by 365 days.

(21) Appl. No.: 11/754,463

(22) Filed: May 29, 2007

(65) Prior Publication Data

US 2008/0242436 A1 Oct. 2, 2008

Related U.S. Application Data

(60) Provisional application No. 60/809,414, filed on May 31, 2006.

(51) Int. Cl.
*A63B 69/36* (2006.01)

(52) U.S. Cl. ..... 473/229; 473/213

(58) Field of Classification Search ..... 473/219, 473/226, 229, 257

See application file for complete search history.

(56) References Cited

U.S. PATENT DOCUMENTS

| | | | | |
|---|---|---|---|---|
| 2,655,378 | A * | 10/1953 | Sheffer | 473/229 |
| 2,788,214 | A * | 4/1957 | Tilden | 473/213 |
| 5,158,299 | A * | 10/1992 | Otter | 473/229 |
| 5,458,340 | A * | 10/1995 | Jackson | 473/229 |
| 6,592,474 | B1 * | 7/2003 | Halsworth | 473/453 |
| 6,949,035 | B1 * | 9/2005 | Halsworth | 473/453 |

* cited by examiner

*Primary Examiner*—Nini Legesse

(57) ABSTRACT

A method for golf swing training. In one embodiment, the method comprises a weighted club with directional mountings attached to a resistance means. The resistance means applies force from behind forcing the squaring up of the club face. The disclosed technology comprises a pulley system that allows for the variable resistance associated with the various exercises. By not using a traditional golf head and using directional mountings, the device is no longer dependent on the club face orientation but rather, the golf plane.

19 Claims, 7 Drawing Sheets

MOVE POWER SYSTEM FOR GOLF

CROSS-REFERENCE TO RELATED APPLICATIONS

This application claims the benefit under 35 U.S.C. §119 (e) of U.S. Provisional Patent Application No. 60/809,414, filed May 31, 2006, the disclosure of which is incorporated herein by reference in their entirety for all purposes.

STATEMENT REGARDING FEDERALLY SPONSORED RESEARCH OR DEVELOPMENT

Not applicable.

BACKGROUND

1. Field of the Invention

This invention relates generally to the field of physical training. More specifically, the invention relates to a method of training a golfer.

2. Background of the Invention

As the sport of golf continues to evolve the requirement for advanced training and conditioning methods need to advance as well. On the market today are various devices that address speed, resistance exercises, laser training all addressing specific areas of the golf swing. In many cases the devices were developed by either people in the fitness industry that may or may not be familiar with the key components of the golf swing or by golfers who are not aware of the latest training methods.

If we evaluate the golf swing we consider the take away of the club from the ball, golf planes and a consistent impact follow-through of the swing. In the market place there are training aids that are weighted clubs, some use resistance bands but they do not address the consistent impact of striking the ball striking. What is required to be successful is a fully integrated training solution that focuses on the key movements of the golf swing that is designed for golf conditioning and muscle memory at the "Hitting Zone" or about 24 inches on either side of striking the ball. The present invention is directed to a golf swinging aid focusing on what is commonly referred to as the "Hitting Zone" conditioning the core golf muscles and related muscle memory throughout the Hitting Zone for up to about 24 inches either side of striking of the ball.

Consequently, there is a need for a golf training apparatus for the "Hitting Zone."

SUMMARY

These and other needs in the art are addressed in one embodiment by a method for golf swing training. In one embodiment, the method comprises a weighted club with directional mountings attached to a resistance means. The resistance means applies force from behind forcing the squaring up of the club face. The disclosed technology comprises a pulley system that allows for the variable resistance associated with the various exercises. By not using a traditional golf head and using directional mountings, the device is no longer dependent on the club face orientation but rather, the golf plane.

The foregoing has outlined rather broadly the features and technical advantages of the invention in order that the detailed description of the invention that follows may be better understood. Additional features and advantages of the invention will be described hereinafter that form the subject of the claims of the invention. It should be appreciated by those skilled in the art that the conception and the specific embodiments disclosed may be readily utilized as a basis for modifying or designing other structures for carrying out the same purposes of the invention. It should also be realized by those skilled in the art that such equivalent constructions do not depart from the spirit and scope of the invention as set forth in the appended claims.

DESCRIPTION OF THE DRAWINGS

For a detailed description of the preferred embodiments of the invention, reference will now be made to the accompanying drawings in which.

DETAILED DESCRIPTION OF THE PREFERRED EMBODIMENTS

Introduction. The "Move Power System" according to this disclosure is unique in that it was created by a golfer who has been is now in the fitness industry. Without wishing to be limited by theory, most golfers have problems with a consistent swing as well as getting enough club head speed with the power behind the swing to score their lowest scores. The design concept behind the product was to address the conditioning of the neuromuscular systems; resulting in enhanced muscle memory throughout the "Hitting Zone" of the ball. The training methodology was developed to be used for injury rehabilitation, conditioning during the off-season, and specific conditioning routines during the season itself. The "Move Power System" For Golf is unique in the conditioning of all of the core golf muscles in conjunction with the golf swing. The system focuses on the take away of the club from the ball, as well as, the forward motion of the club striking and the related neuromuscular systems memory. The primary design focus is for the bottom 24 to 36 inches of the swing otherwise known as the "Hitting Zone" and resistance squaring up of the club head at impact. The product was designed to consider golf planes, or directional aiming points, versus the open or closed position of the golf head in the "Hitting Zone".

Figure 1:
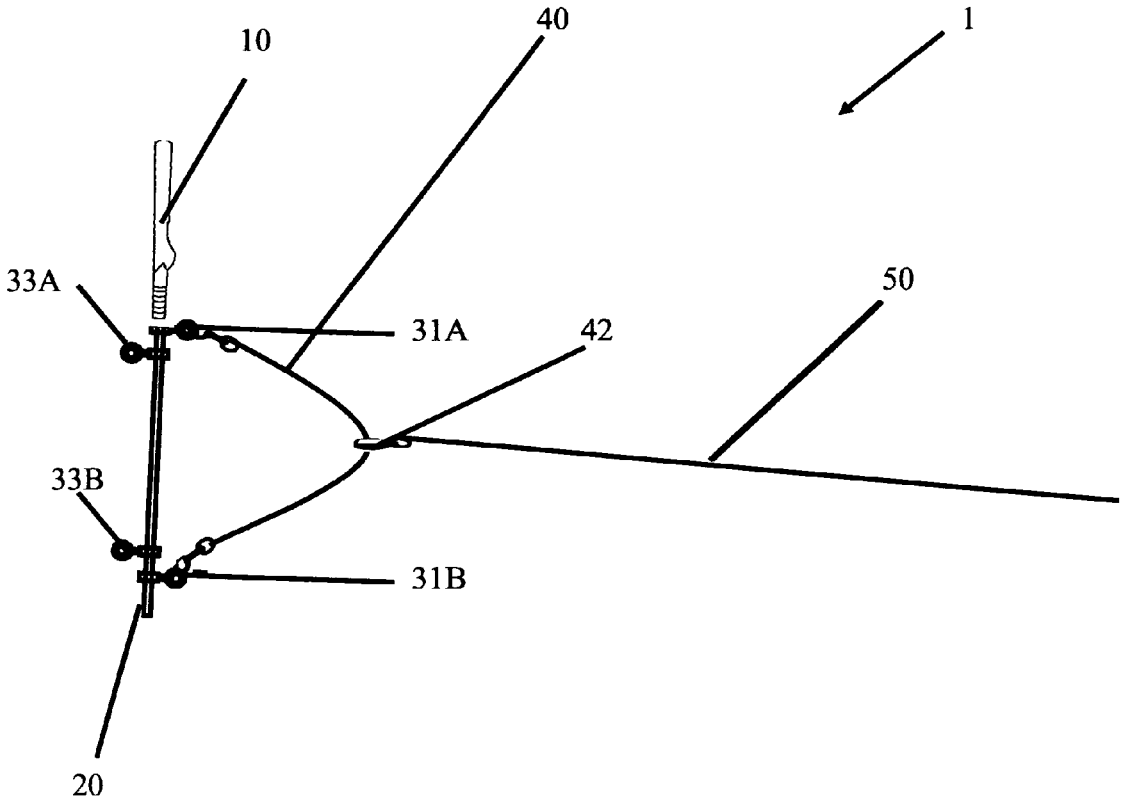
FIG. 1 illustrates the components according to one embodiment of the invention, including the molded grip, weighted shaft with attached directional mountings, Y-band technology and attached resistance band.

Components. FIG. 1 illustrates the components of the system 1, connected with the molded grip 10, weighted shaft 20 with attached directional mountings 30, Y Band technology 40, and attached resistance band 50. First directional mountings 31A and 31B are also shown; these comprise Y-band mount Position #1. Second directional mountings 33A and 33B are identified; these comprise Y-band mount Position #2. The product, system 1, is a golf swing training device focusing on muscle memory through the use of the Y Band Technology 40, pulley system 41, resistance band 50, a weighted club, or shaft 20 with a molded grip 10.

Figure 2:
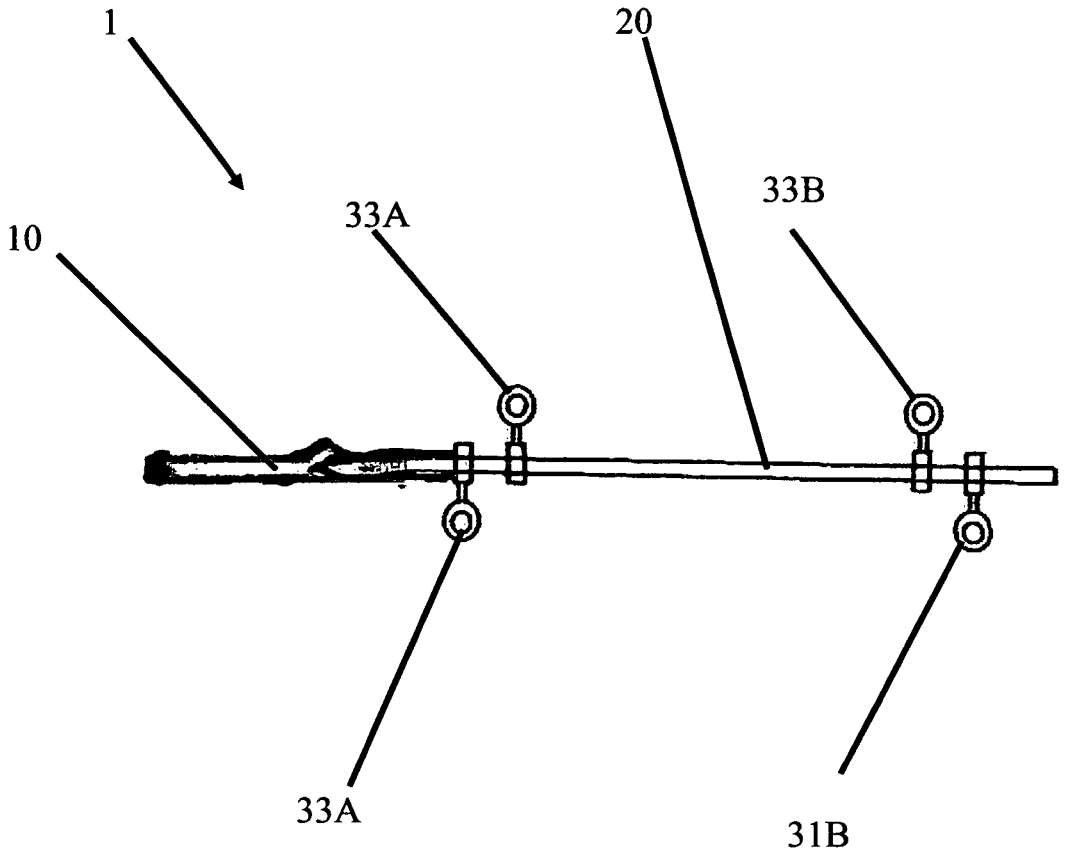
FIG. 2 illustrates the detail on the weighted shaft, attached directional mountings.

FIG. 2 illustrates another detail of the weighted shaft, attached eye bolts/directional mountings at a 90 degree connection to the molded grip. The directional mountings 31A, 31B, 33A, 33B on the shaft 20 comprise eyebolts. The directional mountings 31A, 31B, 33A, 33B on the shaft 20 connected to the Y Band technology 40, pulley system 42 is designed to ensure consistent swing planes during the backswing and forward swing throughout the Hitting Zone.

Figure 3:
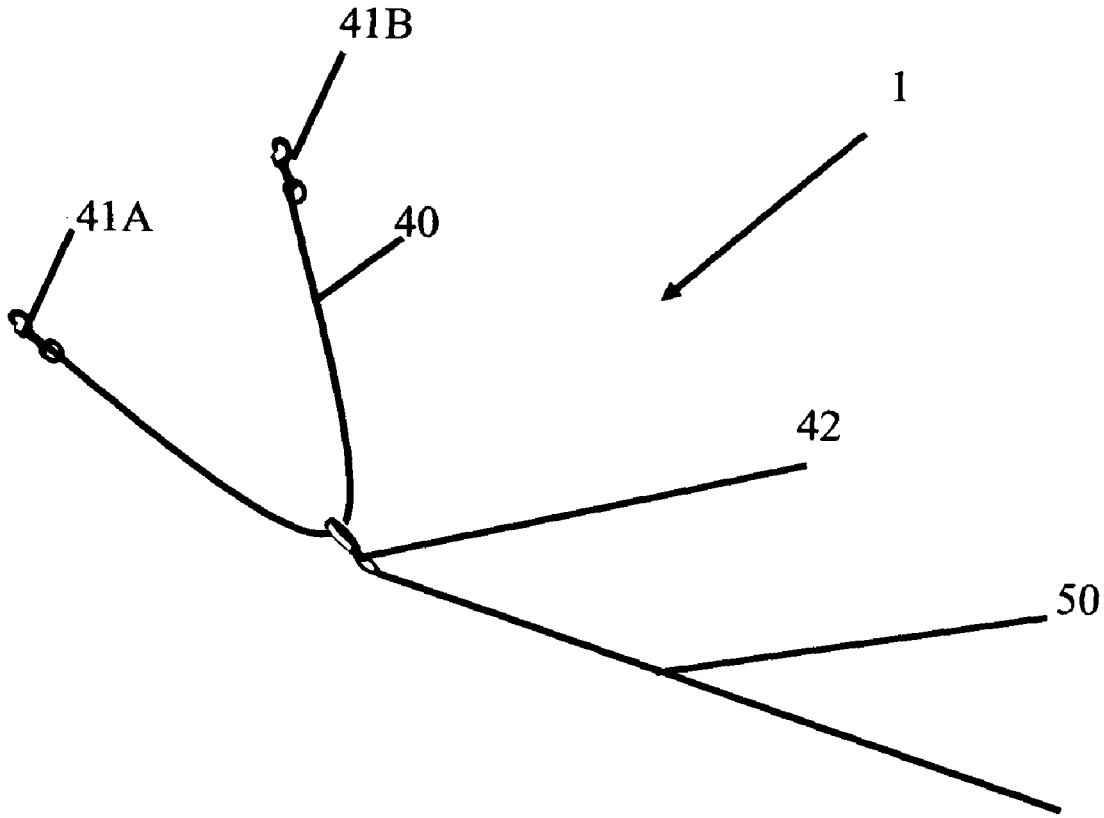
FIG. 3 illustrates the Y-band technology, including a connectors, flexible cable, rope and pulley.

FIG. 3 illustrates the Y Band technology 40 which consists of connectors 41A, 41B to the directional mountings 31A, 31B, or 33A, 33B, flexible cable, rope, or Y-band technology 40 and pulley 41. The Y Band technology 40 coupled to bands 50 allows for the variable resistance which is key to the operation of the product. The system uses bands 50 with from 2.6 to 13.2 pounds resistance.

Figure 4:
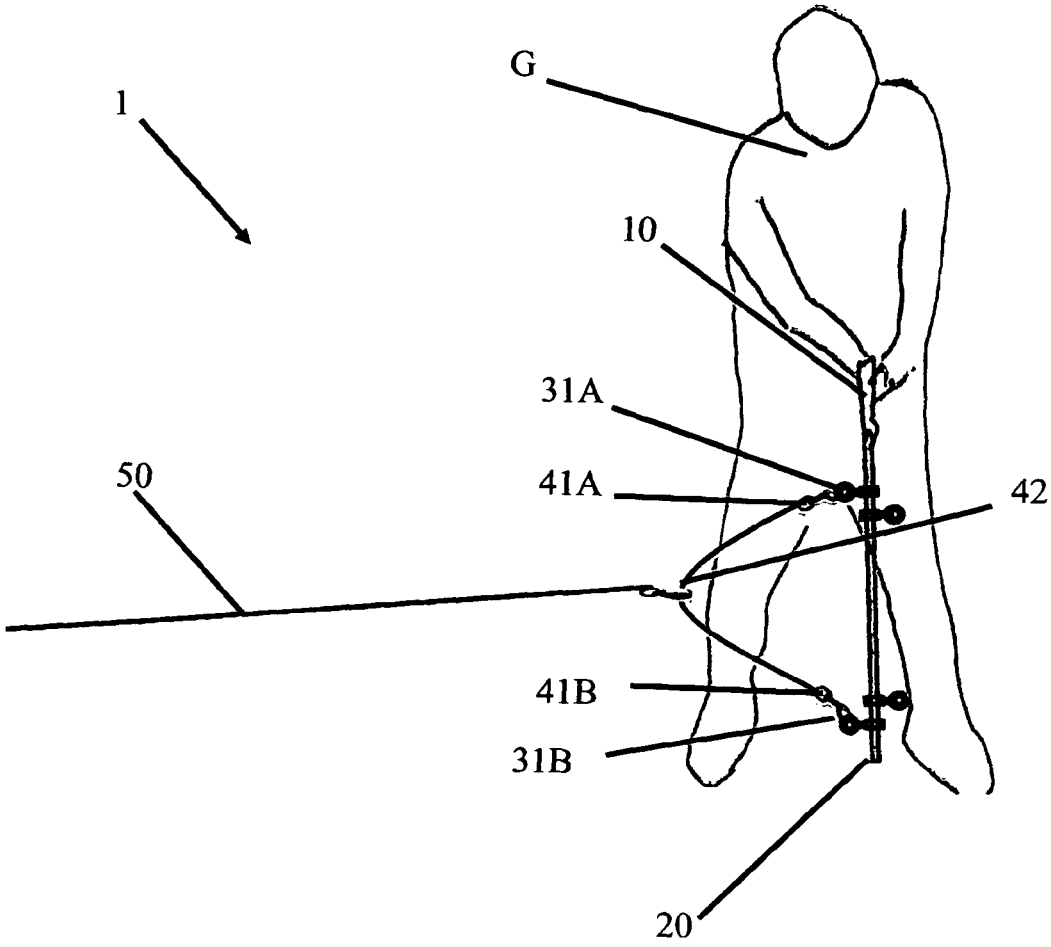
FIG. 4 illustrates the golfer in the Power Move and Open Stance Power Move positions.

FIG. 4 illustrates the golfer in the Power Move and Open Stance Power Move positions, or #1 position. With the Open Stance Power move, the legs are open to a 45 degree where the belly button on the person would be facing the target. With a right handed golfer this would focus on building the associated neuro-muscular systems on the right side of the body. In this position, the system 1 is assembled such that Y-Band technology 40 is coupled to the first directional mountings 31A, 31B at connectors 41A, 41B. Resistance from behind will force a natural squaring up of the club face and producing a more powerful swing with increased club head speed and greater accuracy. The Move Power System 1 for Golf has specific exercises that are designed to work with include the following: The power move with the resistance from behind, the golfer G in a traditional stance and the Y Band Technology 40 coupled to the first directional mountings 31A, 31B, comprising the #1 position as illustrated in FIG. 4. The Open Stance Power Move is a specific exercise designed with the resistance from behind, the golfer in an open stance in the #1 position.

Figure 5:
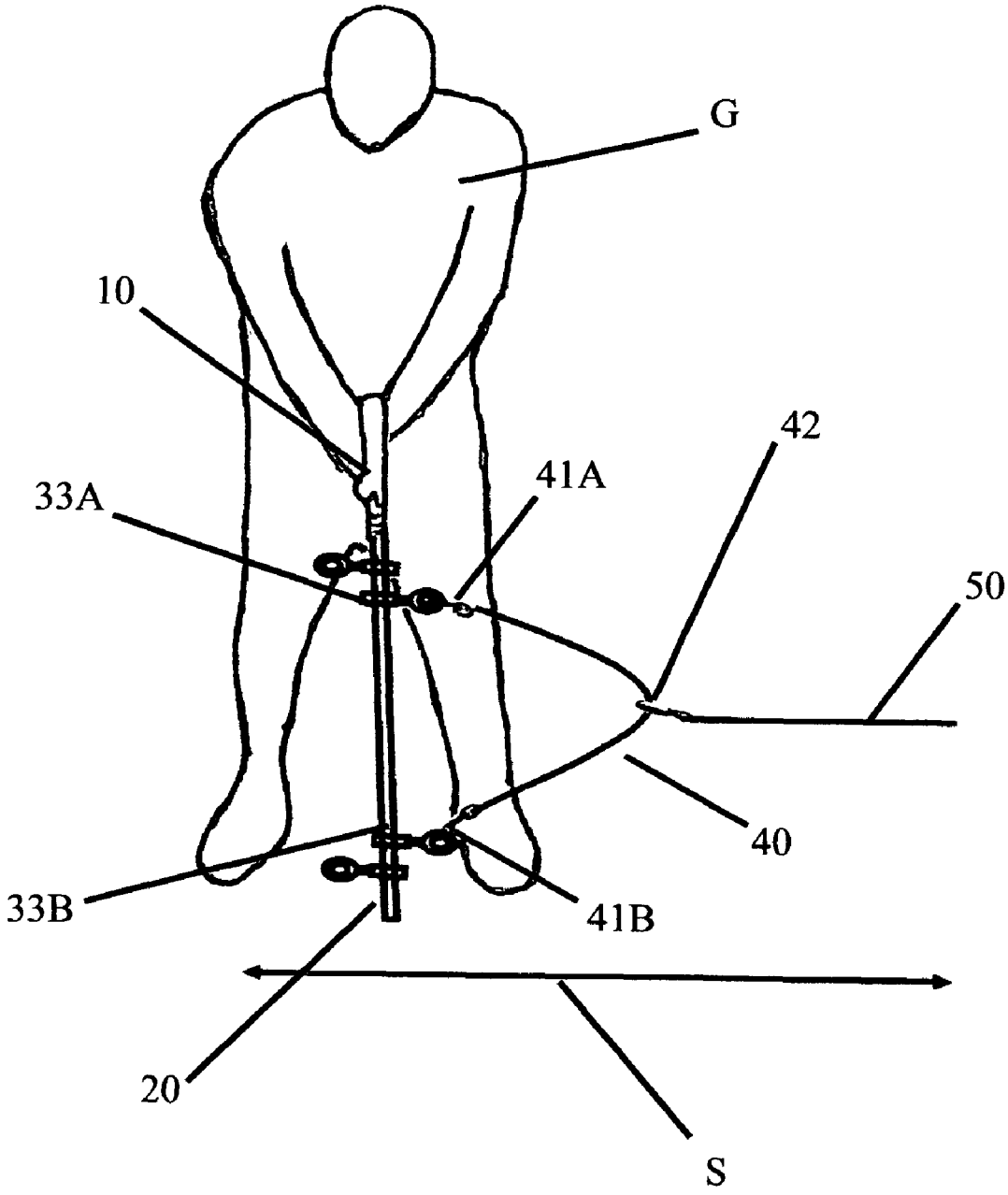
FIG. 5 illustrates the Power Take-Away position.

FIG. 5 illustrates the Power Take-Away position which focuses on the take away from the ball movement and addresses the left side of the body neuro-muscular systems, for a right handed golfer in the #2 position. This is necessary for muscle balancing of the Power Move exercise. In the system 1, the Y-band technology 40 is coupled to the second directional mountings 33A, 33B at connectors 41A, 41B. These exercises focus on the bottom 24 to 36 inches of the swing S using adjustable resistance bands 50 from 2.6 to 13.2 pounds. This allows people of all sizes and strengths to benefit from the product, or system 1. Power Take away with resistance bands 50 are positioned in front of the golfer in a traditional stance. The Y Band Technology 40 in coupled to the second directional mountings 33A, 33B to form the # 2 position as illustrated in FIG. 5. For the Power X Factor with the golfer in a traditional stance, the Y-Band Technology 40 in the #2 position.

Figure 6:
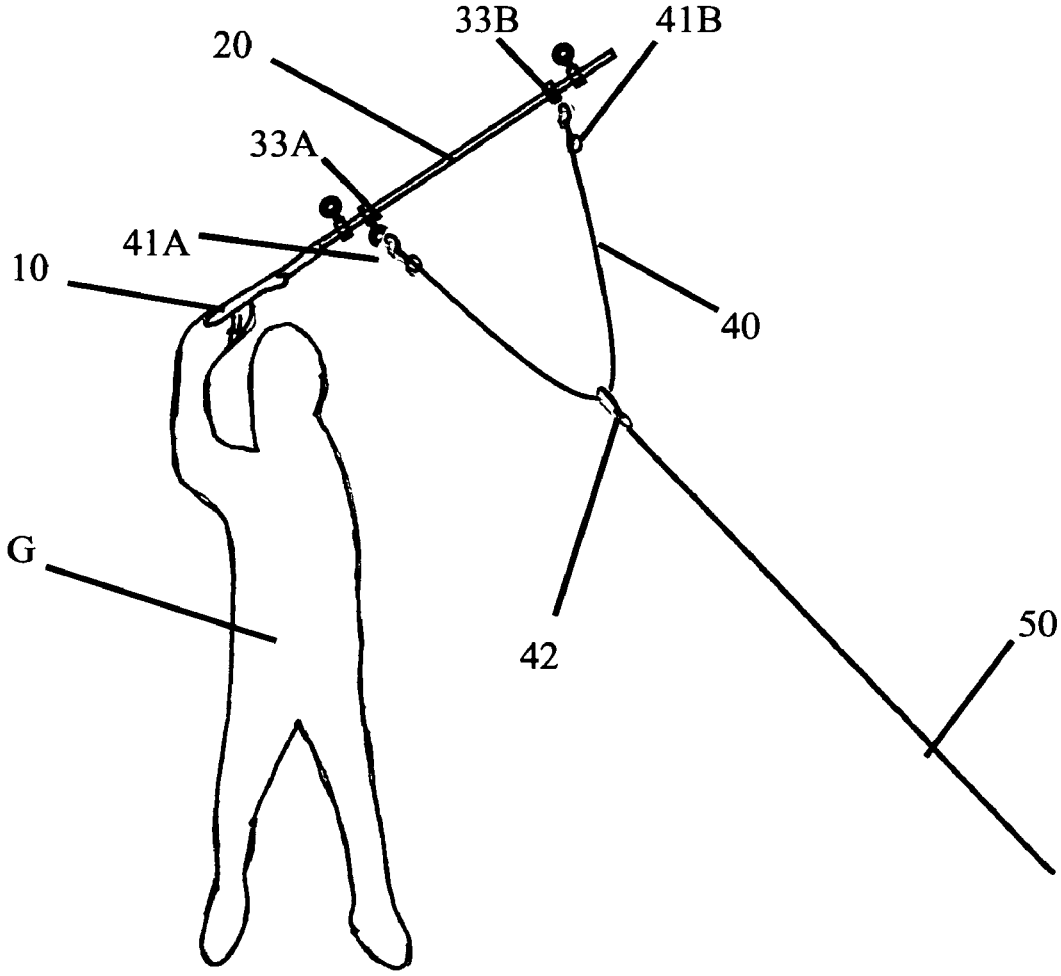
FIG. 6 illustrates the golfer using The Move Power System to stretch the body allowing for a complete and powerful backswing.

FIG. 6 illustrates shows the golfer G using The Move Power System 1 for Golf to stretch the body allowing for a complete and powerful backswing. This is an isometric exercise.

Strength. The system uses bands 50 from 2.6 to 13.2 pounds resistance. The bands 50 are attached to either weights on the floor, or to a doorknob or other stationary fixed object. The Y-Band Technology 1 with pulley system 42 allows for variable resistance to the weighted club or shaft 20. With the Power Move exercise all of the core muscles from the arms to the legs are strengthened focusing on the follow through on the swing for the golfer G. The Open Stance Power Move also addressed the core muscles of the swing with more emphasis on the abdominal muscles and moving the hips through the ball. The Power Take Away the core muscles of the take away are conditioned, addressing muscle balancing. The Power X Factor is designed to stretch the golf muscles at the start of the down swing. The primary exercise is to designed assist with a full swing.

Figure 7:
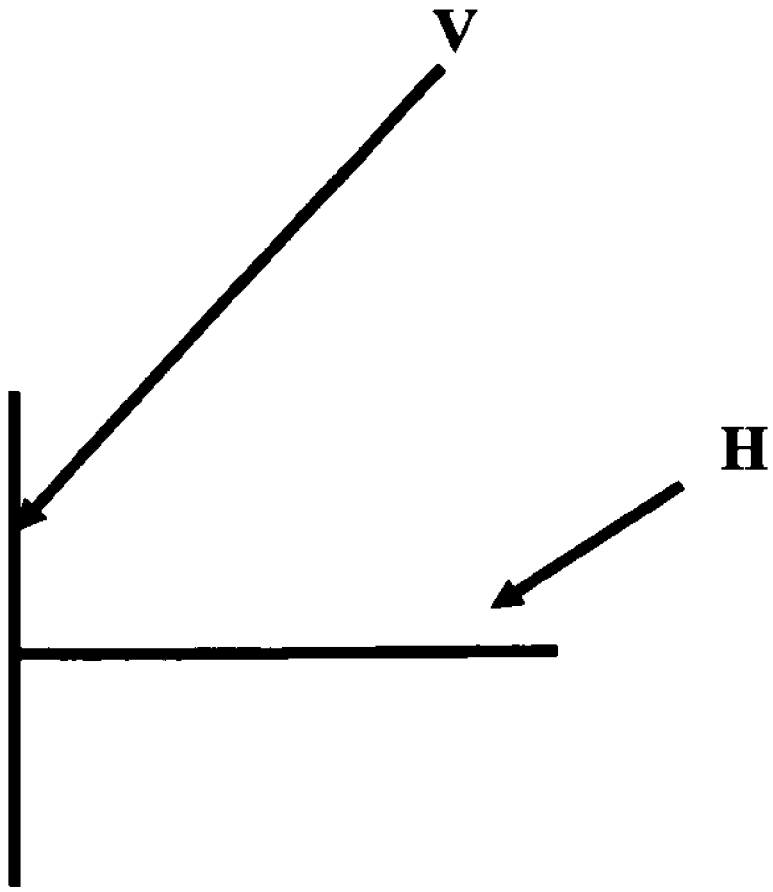
FIG. 7 illustrates the envisioned forces and planes that square up the club face at during use according to one embodiment of the invention.

Accuracy. By using a combination of the eye bolt/first directional mounting attachments 31A, 31B, or 33A, 33B, resistance from behind, the Y-Band Technology 40 and the molded grip 10, direction is no longer tied to whether a clubface is open or closed. Eye Bolt Attachments 31A, 31B are set on the far end of the weighted club, up to strengthen position 1# of FIG. 3. And allow the golfer G to focus in on a golf plane The molded grip 10 allows for the golfers hands to remain in the correct position #1 at all times. The Y-Band Technology 40 allows the golfer G to have a smooth transition of the club with the appropriate variable resistance from the associated exercises. The resistance band(s) 50 allows for the natural square up of the club by pulling on the associated exercise. This is accomplished by the resistance band(s) 50 pulling from behind and the relationship of the eye bolt/directional mounting attachments 31A, 31B and grip 10 being mounted at a 90 degree. As illustrated in FIG. 7, this can be visualized by the pulling from behind to the vertical plane V and the horizontal plane H is the resistance band(s) 50.

Consistency. All of the exercises are designed to develop not only strength but muscle memory at the key parts of the "Hitting Zone". The exercises build up the muscle memory through the specific conditioning drills that greatly increase the consistency of the swing. The Power Move and Open Stance Power Move address the consistency of the follow through of the swing position as illustrated in FIG. 4. The Power Take Away builds the consistency of the first movement of the club away from the ball which positions a consistent take-away and illustrated further in FIG. 5.

"The Move Power System for golf" is designed as a training aid to provide variable resistance as well as isometric exercise for the golf swing. The system has three components, as described in FIG. 1: a training bar ("shaft") 20 with a molded grip 10, A Y-band 40, pulley 42 system for smooth variable resistance. Additionally, from 1 to 3 resistance bands 50 and related attachments to connect a door, golf carts at the golf course, or other fixed stationary object.

The Training Bar 20 is a weighted club that has attached Eye Bolts/Directional Mountings to focus on direction 31A, 31B, or 33A, 33B, a standard molded grip 10 mounted at a 90-degree angle to force a natural square up of the club on impact once the resistance is a applied using the resistance bands 50. The Y-Band Technology 40 Consists of connectors 41A, 41B, a pulley 42 and rope 40 that will be attached to the bar 20 to allow for the variable resistance that will be key for all of the exercise. The Resistance Bands 50 are industry standard bands with resistance from 2.6 pounds to 13.2 pounds.

The primary exercises are as follows. The Move itself focuses on the bottom 24 to 36 inches of the swing S. The exercise is a repetitive movement at the Hitting Zone with the variable resistance band(s) 50 kept tight at all times. Exercises are repetitive and from 24 to 36 inches. The power, take-away building strength in the backswing. This exercise applies the same concepts of the Power Move with regards to repetition as the golfer takes the club away from the Hitting Zone. Exercises are repetitive and from 24 to 36 inches. The Power X Factor illustrated in FIG. 6 is designed to be more of a stretching exercise with resistance. The club coupled to second mountings 33A, 33B, and holding the position for up to 30 seconds depending on the conditioning of the athlete.

What is claimed is, the use of Eye Bolts/Directional Mountings (directional mountings) attached at a 90 degree angle will assist the golfer by the use of golf planes verses opening or closing of the club head. Variable resistance bands attached to the Y band technologies connected to the directional mountings will force a natural squaring up of the golf head at the Hitting Zone Exercises focusing throughout the Hitting Zone at the bottom 24 to 36 inches of the swing will create the neuro-muscular memory for a consistent golf swing. The exercises are of a repetitive motion at the Hitting Zone of the ball. The combination of the club and the interchangeable resistance bands will allow a golfer to greatly enhance the power at impact. The Y-band technology allows for easy transition of resistance and smooth execution of the exercise. The Y-band technology is key to the resistance from behind to square up the club at impact. The power x factor exercise will allow a golfer to stretch the golf muscles and allow for a full swing. The Move Power System for golf is designed to be a conditioning system that will improve the golfer's swing with strength, accuracy and consistency

What is claimed is:

1. A golf training apparatus, comprising:

a weighted shaft, having a first end, and a second end, and a longitudinal axis running therebetween, the longitudinal axis defining a vertical plane along the shaft;

a grip disposed on the first end of the shaft;

at least two pair of mounting means, reversibly coupled to the shaft, a first pair of mounting means disposed proximal to the first end, and a second pair of mounting means disposed proximal to the second end, wherein each pair of mounting means has a first means on a first side of the vertical plane, and a second means on a second side of the vertical plane;

a first Y-band, running from first end to a second end, each end having one connector means, the first end connector means coupled at least one of the first pair of mounting means, the second end connector means coupled to at least one of the second pair of mounting means, wherein the first end connector means and the second end connector means are disposed on the same side of the vertical plane;

and a pulley coupled to the Y-band configured for moveable coupling to the Y-band.

2. The apparatus of claim 1, wherein the vertical plane comprises a plane of manual interface through the weighted shaft.

3. The apparatus of claim 1, further comprising at least one additional Y-band, having a first end coupled to the second one of the first pair of mounting means and a second end coupled to the second one of the second pair of mounting means, and wherein the at least one addition Y-band—is disposed on the opposite side of the vertical plane from the first Y-band.

4. The apparatus of claim 1, wherein the Y-band comprises a resistance band.

5. The apparatus of claim 4, wherein the Y-band provides a resistance of at least about 2.6 lbs.

6. The apparatus of claim 1, wherein the pulley comprises an elastic means is configured to reversibly attach to a stationary object normal to the plane of manual interface.

7. A golf training apparatus, comprising:

a weighted shaft, having a first end having a grip, and a second end, with a vertical plane disposed therebetween;

at least two pair of mounting means, each reversibly coupled to the shaft at each end, each one of each pair mounting means at each end disposed on opposite sides of the vertical plane;

at least one Y-band, coupled to at least one mounting means at each ends, the mounting means disposed on the same side of the vertical plane; and a resistance means, having a first end and a second end, coupled to the at least one Y-band at the first end by a pulley system that is configured for sliding along the Y-band.

8. The apparatus of claim 7, wherein the vertical plane further comprises a golfer's plane of manual interface.

9. The apparatus of claim 8, wherein the at least one resistance means is further configured to apply resistance during a golf swing normal to the plane of manual interface.

10. The apparatus of claim 9, wherein the at least one resistance means is configured to apply resistance within at least 24 inches of striking a simulated golf ball in a golf swing.

11. The apparatus of claim 10, wherein the at least one resistance means is configured to apply resistance in at least two additional planes normal to the vertical plane of the weighted shaft.

12. The apparatus of claim 7, wherein the at least two mounting means comprise:

a metallic ring configured for attaching the Y-band, and a clamping means, configured for holding the metallic ring to the weighted shaft.

13. The apparatus of claim 7, wherein the Y-band comprises an un-deformable band.

14. The apparatus of claim 7, wherein the resistance means is slidably coupled to the Y-band by at least one component chosen from the group consisting of: pulleys, sliders, loops, or combinations thereof.

15. The apparatus of claim 7, wherein the resistance means is configured to reversibly attach to a stationary object normal to the vertical plane of the weighted shaft.

16. A golf training apparatus, comprising:

a weighted shaft, having a first end, and a second end, a grip disposed on the first end of the shaft, having a vertical plane of manual interface extending from the grip to the weighted shaft second end;

at least two mounting means, reversibly coupled to the shaft, the first mounting means disposed adjacent to the grip at the first end of the shaft, and the second mounting means disposed at the second end of the shaft;

at least one Y-band, having a length L coupled to the at least two mounting means at both ends, wherein L is greater than about the linear distance between the at least two mounting means along weighted shaft; and a resistance means, consisting of at least one elastic means having a first end slidably coupled to at Y-band and a second end configured for reversible attachment to a stationary object, providing at least 2.5 pounds of resistance.

17. The apparatus of claim 16, wherein the at least two mounting means are disposed on the same side of the plane of manual interface.

18. The apparatus of claim 16, wherein the at least one elastic means is configured to apply resistance with at least 24 inches of striking a simulated golf ball.

19. The apparatus of claim 16, wherein the at least one elastic means is configured to apply resistance along the intended path of a golf swing.

* * * * *